US005603888A

United States Patent [19]

Blizzard et al.

[11] Patent Number: 5,603,888

[45] Date of Patent: Feb. 18, 1997

[54] METHOD OF MAKING FIBERS

[75] Inventors: John D. Blizzard, Bay City, Mich.; Steven E. Cray, Sully, Wales; Jenny L. Gilles, Bay City, Mich.; Daniel Graiver, Midland, Mich.; Arnold W. Lomas, Rhodes, Mich.; James McVie, Barry, Wales

[73] Assignee: Dow Corning Corporation, Midland, Mich.

[21] Appl. No.: 502,040

[22] Filed: Jul. 13, 1995

[51] Int. Cl.[6] ..... D01D 5/06; D01D 5/12; D01F 6/96

[52] U.S. Cl. ..... 264/477; 264/166; 264/185; 264/187; 264/210.8; 264/211.16

[58] Field of Search ..... 264/166, 178 F, 264/185, 187, 203, 205, 210.8, 211.12, 211.16, 477

[56] References Cited

U.S. PATENT DOCUMENTS

| | | | |
|---|---|---|---|
| 4,584,341 | 4/1986 | Huebner et al. | 524/837 |
| 4,663,358 | 5/1987 | Hyon et al. | 521/64 |
| 4,783,289 | 11/1988 | Shimizu et al. | 264/28 |
| 4,851,168 | 7/1989 | Graiver et al. | 264/28 |
| 5,368,941 | 11/1994 | Blizzard et al. | 428/412 |

FOREIGN PATENT DOCUMENTS 378194 7/1990 European Pat. Off. .

*Primary Examiner*—Leo B. Tentoni
*Attorney, Agent, or Firm*—James L. DeCesare

[57] ABSTRACT

A process of manufacturing elastomeric fibers in which fibers are obtained by co-extruding an extrudable and curable ≡SiO— containing material and an aqueous organic polymer solution into a coagulation bath. The ≡SiO— containing material is surrounded by the coagulated organic polymer. The ≡SiO— containing material is then cured inside the protective sheath that is formed, and thereafter the organic polymer sheath is dissolved to expose a continuous elastomeric fiber of the ≡SiO— material.

10 Claims, 1 Drawing Sheet

METHOD OF MAKING FIBERS

BACKGROUND OF THE INVENTION

This invention is directed to fibers, and more particularly to methods of making fibers from ≡SiO— containing materials by coextruding a removable organic polymer as an outer sheath, around an inner sheath formed of an extrudable and curable ≡SiO— containing material.

Numerous types of elastomeric fibers are known in the art including fibers characterized by a glass transition temperature below room temperature coupled with high elongation at break, low modulus, and high degrees of recovery from deformation. One of the most important physical properties is the elastic power defined as the force encountered in stretching and retraction repeatedly and any hysteresis or set which remains. Although silicone elastomers are generally weaker than most organic elastomers because of their lower modulus and tensile strength, they can be formulated to have low hysteresis and high elastic power.

Two of the major polymers used in manufacturing elastomeric fibers are natural and synthetic rubber, and various polyurethane based polymeric materials. Such materials, however, suffer from numerous disadvantages. The main deficiency of many of these elastomeric fibers is stretch induced crystallization. While this problem is observed primarily with fibers based on natural rubber, it is also observed to some degree in synthetic elastomers such as spandex polyurethane based fibers. This crystallization occurs as sufficient orientation of the rubber chains takes place at high elongation, and leads to dramatic changes in the mechanical profile of the fiber on subsequent stretching. These changes include an increase in the modulus and lower elongation at break, which are critical for fibers to survive textile processing and wear without breakage.

Another problem of prior art fibers is oxidative degradation which is caused by heat, light, atmospheric fumes, chemical agents, or ultraviolet (UV) radiation. The degradation of the fibers by such agents alters the structure of the polymer, and can drastically affect its mechanical properties. Most notably, chlorine is known to degrade polymers by a free radical chain reaction mechanism. Spandex fibers based on polyether soft segments are particularly susceptible to oxidation and must be protected. While spandex fibers based on polyester soft segments are not as susceptible to oxidation, they tend to hydrolyze at low or high pH values. Other problems with elastomeric fibers for the textile industry relate to their discoloration and staining.

The present invention seeks to overcome these disadvantages, and uses a fiber made from an ≡SiO— containing material which has a protective outer sheath that supports the fiber during manufacture. While European Patent Application 378194 (Jul. 18, 1990) describes an elastomeric fiber spun with a protective sheath, it relates to a polyurethane core arranged in the center of a polyamide sheath, yielding a composite filament yarn. However, unlike our invention, the core in EP 378194 is not an ≡SiO— containing material, and the protective sheath is not removed but forms an integral part of the composite yarn.

SUMMARY OF THE INVENTION

The invention relates to a continuous process of manufacturing elastomeric fibers. The fibers are obtained by co-extruding an extrudable and curable ≡SiO— containing material and an aqueous organic polymer solution into a coagulation bath, such that the ≡SiO— containing material is surrounded by the coagulated organic polymer. The ≡SiO— containing material is then cured inside the protective sheath that has been formed, and thereafter the organic polymer sheath is dissolved to expose a continuous elastomeric fiber. By this process, it has been demonstrated that continuous 600 foot (183 meters) lengths of substantially uniform monofilament as low as 7 microns (micrometers) in diameter can be prepared. The fibers have applications in products such as swim wear, hosiery, undergarments, and outer wear. Some advantages of these fibers over other types of elastomeric fibers include the fact that they are non-yellowing, and have better chlorine, mildew, and stain resistance.

The invention also relates to a continuous process of manufacturing resinous fibers. The resinous fibers are obtained by co-extruding an ≡SiO— containing material which is a silane acrylate silica terpolymer and the aqueous organic polymer solution into a coagulation bath, such that the terpolymer is surrounded by the coagulated organic polymer. The terpolymer is cured inside the protective sheath by passing it through a source of ultraviolet radiation. Thereafter, the organic polymer sheath can be dissolved to expose a continuous and substantially uniform and flexible fiber. Some advantages of these types of fibers over other types of fibers include their light-weight; improved dyability, abrasion resistance, and refractive index; and the variability and ease of control in processing and curing.

These and other features and objects of the invention will become apparent from a consideration of the following detailed description.

DETAILED DESCRIPTION OF THE INVENTION

Figure 1:
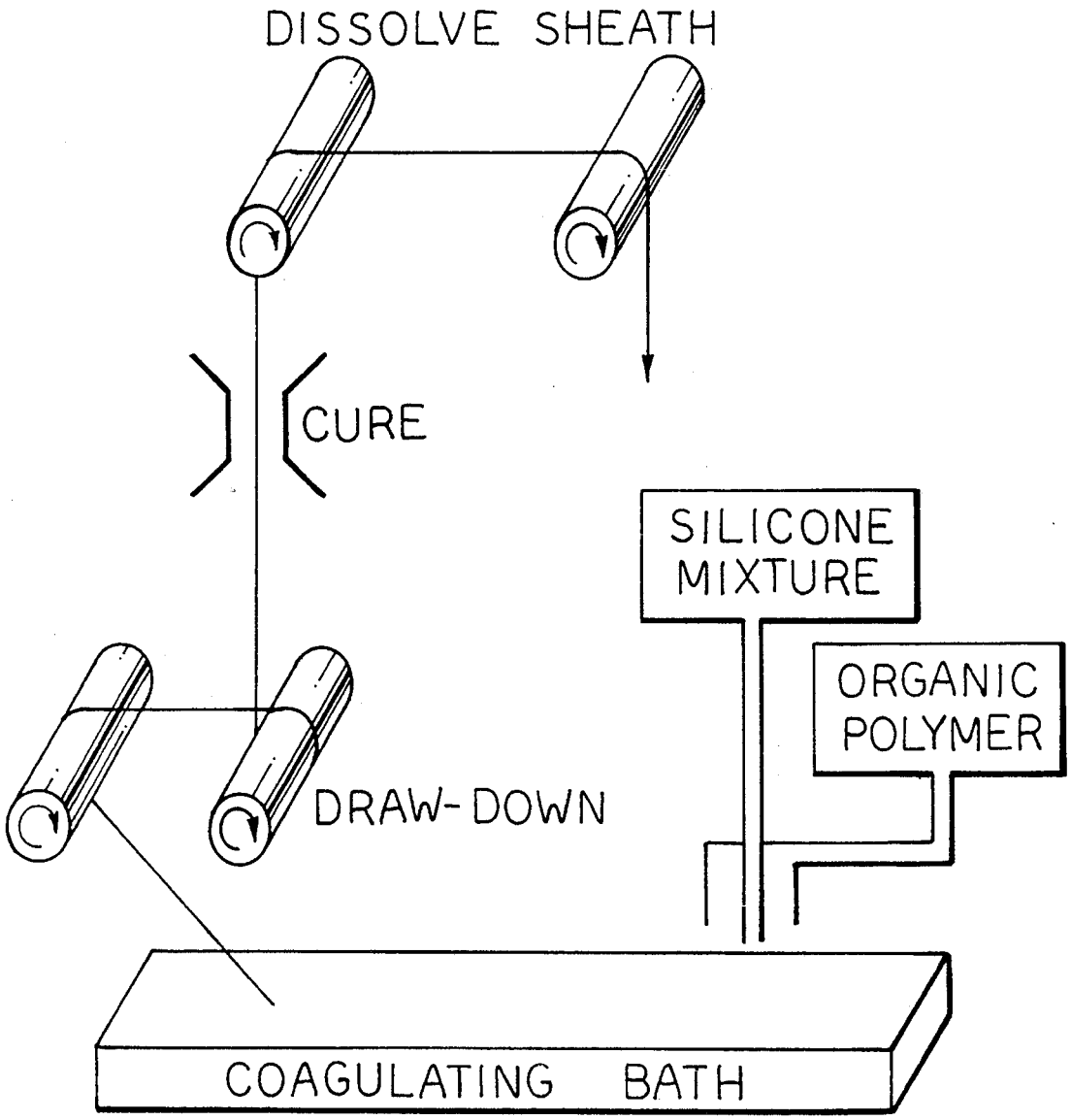
FIG. 1 shows a simplified functional representation of apparatus used to practice methods embodying concepts of the present invention.

We have demonstrated that ≡SiO— containing materials including silane acrylate silica terpolymers can be co-extruded with an aqueous solution of an organic polymer (e.g. polyvinyl alcohol) to form a continuous filament. The ≡SiO— containing material is present as the interior component of the filament, and is completely surrounded by a coagulated organic polymer that acts as a continuous protective sheath around it.

This core-shell arrangement of our multicomponent fiber enables low viscosity liquid filaments to remain in place indefinitely as continuous filaments in spite of their low viscosity. Furthermore, the multicomponent fiber can be drawn down in any conventional process to a desired diameter, and then passed under a UV light source or electron beam (EB) to cure the liquid core into a resin. The UV source does not affect the polymeric sheath, and since it is not crosslinked, it can be removed by simply passing the fiber through an appropriate solvent that will dissolve it.

Since the ≡SiO— containing material and the aqueous organic polymer solution are immiscible, the two components do not mix and remain separate. The multicomponent filament structure is obtained by simultaneously extruding the ≡SiO— containing material and the aqueous organic polymer solution through a spinneret into a coagulating bath. The spinneret is constructed such that the ≡SiO— containing material is extruded through a hollow mandrel surrounded by a concentric cavity into which the aqueous organic polymer solution is extruded. The particular concentric configuration will correspond to the initial configuration of the multicomponent fiber, whereby the ≡SiO— containing material will be present inside the protective sheath of the organic polymer.

The multicomponent fiber is spun into a coagulating bath which causes the organic polymer solution to coagulate and form an elastomeric solid around the ≡SiO— containing material. This elastomeric sheath contains the flowable ≡SiO— material and provides dimensional stability like a temporary mold. The composition of the coagulating bath can be any solvent that will precipitate the extruded organic polymer into a continuous sheath. When polyvinyl alcohol (PVA) is used as the organic polymer, the coagulating bath is composed of cooled acetone or methanol. Cooling is important as gelation of aqueous PVA solutions is known to be accelerated when the temperature of a coagulating bath is kept below room temperature.

As the multicomponent filament is drawn through the coagulating bath, it is collected on a spool or other take-up device. The initial dimension of the filament is dependent on the collecting speed, as well as the pressure applied to the aqueous polymer, and the viscosity of the ≡SiO— containing material. The pressure and collecting speed are also related to the temperature and viscosity of the two components.

Since it is often desired to obtain fine diameter filaments, the ≡SiO— containing material can be added slowly compared to the addition rate of the PVA, and a relatively fast collecting speed can be used. Slow addition of the ≡SiO— containing material with respect to the PVA will ensure an appropriate thick sheath free of pin-holes, that prevents loss of the ≡SiO— containing material. Relatively high collecting speeds allow for the production of multifilament fibers with fine diameters.

After the ≡SiO— containing material is inside the protective organic sheath, the multicomponent fiber can be further drawn to any desired dimension. When PVA is being used, a draw down ratio of 1:10 has been found to be appropriate. The drawn down does not adversely affect the ≡SiO— containing material inside the fiber since it is uncured and able to flow into smaller fibrillar diameters. Drawing the multicomponent fiber to a precise and predetermined diameter can be readily accomplished by using a take-up roll rotating at a higher speed than a feed-up roll. The draw down process can further be facilitated by applying heat, at least up to the melting point of the organic sheath.

When the proper dimension has been achieved, the ≡SiO— containing material can be cured in the usual way. The cure will depend on the type of ≡SiO— containing material being used. Thus, if a crosslinking reaction is initiated by using peroxides, the multicomponent fiber can be drawn through a hot zone to initiate formation of free radicals. Similar arrangements can be used when other types of curing systems are used, including the addition of inhibitors where appropriate. In such cases, the inhibitor is added to inhibit any crosslinking reaction during spinning, coagulation, and draw-down, operations, but upon heating of the resulting fiber, crosslinking of the ≡SiO— containing material will be initiated.

Where the ≡SiO— containing material is a silicone emulsion composed of a high molecular weight diorganosiloxane, a silane, reinforcing filler, and crosslinking catalyst, a continuous silicone elastomeric fiber can be obtained by a cure that simply involves removing the water. This cure can be achieved by drying or extracting the water through the organic polymer sheath.

Where the ≡SiO— containing material is a silane acrylate silica terpolymer, it is cured by simply passing it under a UV source. The crosslinking reaction mechanism (cure) is not affected by the spinning, coagulation, and draw-down operation. Cure can be initiated in a short time under a UV source of approximately 1 J/cm$^2$ radiation, and leads to a continuous resin filament encapsulated inside a protective organic polymer sheath.

One notable element of our invention is removal of the organic polymer sheath from around the cured fiber. Since the outer polymer sheath is not crosslinked, it can easily be removed by simply dissolving it in a proper solvent. When PVA is employed, solvents such as boiling water, hot dimethylsulfoxide (DMSO), or mixtures thereof, are sufficient for dissolving the outer polymer sheath.

Our process for spinning fibers, coagulating the organic polymer sheath, drawing, curing the ≡SiO— containing material, and removing the protective sheath, can be carried out on a continuous process, and this process is depicted schematically in FIG. 1. The process can be modified for the production of multifilament bundles by modification to the configuration of the spinneret.

Representative ≡SiO— containing materials which can be used according to our invention are (i) a curable silicone rubber, (ii) a curable water based silicone emulsion, and (iii) a curable silane acrylate silica terpolymer. The following examples illustrate the use of each of these representative types of ≡SiO— containing materials in making fibers according to our invention.

EXAMPLE 1

CURABLE SILICONE RUBBER

A 12% by weight solution of polyvinyl alcohol (PVA) having a number average molecular weight of 89,000 and a degree of saponification above 99 mole percent was prepared in an aqueous dimethylsulfoxide (DMSO) solution. The ratio of water to DMSO in the solution was 1:4 based on weight.

Methods of preparing these solutions in detail are described in U.S. Pat. No. 4,663,358 (May 5, 1987) and U.S. Pat. No. 4,851,168 (Jul. 25, 1989), both incorporated herein by reference. The former '358 patent relates to aqueous solutions, whereas the latter '168 patent which is assigned to the same assignee as our invention relates to both aqueous and non-aqueous solutions. As noted in these patents, while DMSO is the preferred solvent for use in conjunction with water, other organic solvents can be used such as acetone, methyl alcohol, ethyl alcohol, n-propyl alcohol, isopropyl alcohol, aminoethyl alcohol, phenol, tetrahydrofuran, dimethyl formamide, glycerine, ethylene glycol, propylene glycol, and triethylene glycol. The concentration of PVA in these solutions can vary from 2–50% by weight, and the water:organic solvent ratio varies from 90:10 to 10:90.

The solution was heated to 110° C. with continuous stirring under an inert nitrogen atmosphere for one hour until the PVA was completely dissolved. The PVA solution was poured into container "A" and maintained at 80° C.

A curable silicone composition was prepared containing 97.29 grams of a dimethylhexenylsiloxy terminated siloxane polymer containing dimethyl and methylhexenyl siloxane units, 4.0 grams of a dimethyl methylhydrogen polysiloxane crosslinking agent having a viscosity of about 30 mm$^2$/s at 25° C. and containing about one weight percent ≡SiH, 1.9 grams of a one percent solution of 1,3-divinyl-1,1,3,3-tetramethyldisiloxane complex of platinum in a dimethylvinylsiloxy terminated dimethylsiloxane (equivalent of 0.0095 grams of platinum), and 0.81 grams of the inhibitor bis-(2-methoxy-1-methylethyl) maleate.

Any type of curable silicone rubber can be used as the curable silicone composition. Such compositions are described in detail in various patents including U.S. Pat. No. 4,783,289 (Nov. 8, 1988) which is incorporated herein by reference. In general, these compositions typically include a liquid, reactive group containing organopolysiloxane, a crosslinking agent, and curing catalyst for the organopolysiloxane. They cure to elastomers by standing at room temperature or application of heat. Cure mechanisms include addition reactions, free radical reactions, and condensation reactions, the details of which are pointed out and explained in the '289 patent.

Examples of suitable liquid, reactive group containing organopolysiloxanes are polysiloxanes containing at least two alkenyl radicals bonded to silicon. Examples of suitable crosslinking agents are polysiloxanes containing at least two silicon bonded hydrogen atoms. Examples of suitable curing catalysts are chloroplatinic acid, platinum black, and platinum supported on a carrier. Other additives can be included such as fillers, heat stabilizers, flame retardants, and inhibitors.

The curable silicone mixture was vigorously stirred to insure complete mixing and poured into container "B". The PVA solution from container "A" and the silicone mixture from container "B" were extruded simultaneously through the annular passage of a die assembly consisting of a circular inner passage having a diameter of 3.7 mm into which the silicone mixture was directed, and a concentric annular passage having an inner diameter of 5.9 mm and an outside diameter of 10 mm into which the PVA solution was directed. Adjustments to the flow of the silicone mixture and the PVA solution were made by controlling the pressure above these components. Under the temperature and viscosity conditions of the above solution, the PVA solution was extruded under 12 psi (83 kPa) and the silicone mixture was extruded under 10 psi (69 kPa). The tip of the spinneret was set vertically about 2 cm above a coagulating bath composed of acetone cooled with dry ice. The extruded multicomponent filament traveled in the bath a total distance of 244 cm and was pulled by a winder rotating at 110 RPM (1.2 rad/s). This was sufficient to completely solidify an outer sheath of PVA around the core silicone component. The speed of the take-up winder was controlled to affect the dimension of the extruded multicomponent filament. The wound multicomponent filament was immersed in acetone after the winding operation, and drawn down at room temperature by transferring it to another spool rotating at a higher speed than the feeding spool. Draw down was repeated twice to a final filament diameter of 7 micrometers. The second draw down was accomplished such that the stretching filament was passed through a hot zone 140° C. to initiate the cure reaction in the silicone mixture. Portions of the filament composed of the cured elastomeric silicone core surrounded by the PVA protective sheath were immersed in boiling water or hot DMSO solution (90° C.) to dissolve away the PVA and release the silicone elastomeric fiber. A simplification of this procedure is shown in FIG. 1 in the drawing.

EXAMPLE 2

CURABLE WATER BASED SILICONE EMULSION

The extrusion process in Example 1 was repeated except that a curable water based silicone emulsion was used instead of the platinum cured silicone mixture. Water from the silicone emulsion was allowed to evaporate through the PVA, and the PVA was dissolved from the multicomponent fiber as in the previous example.

Such curable water based silicone emulsions are described in detail in U.S. Pat. No. 4,584,341 (Apr. 22, 1986) which is incorporated herein by reference. They are made by homogenizing a hydroxyl endblocked polydiorganosiloxane $HO(R_2SiO)_xH$, a surface active anionic catalyst such as dodecylbenzene sulfonic acid or hydrogen lauryl sulfate, and water, to form an oil-in-water emulsion. An alkoxysilane such as methyltrimethoxysilane is added to the emulsion, and the emulsion is maintained at 15°–30° C. for 5 hours at a pH less than 5. The pH is raised to more than 7, and a reinforcing agent such as colloidal silica sol or colloidal silsesquioxane is added to the emulsion to form a latex. Removal of water from the latex by evaporation at room temperature or by heating yields an elastomer as described in the '341 patent.

Elastomeric silicone fibers made according to Examples 1 and 2 find use in various textile applications such as the preparation of bare yarns, covered yarns, or core-spun yarns. These yarns can be used in diverse markets including medical bandages, sheets, and mattress pads; parachute cords; winding cores in golf balls; and as a stretched fabric over a foam layer for furniture.

EXAMPLE 3

CURABLE SILANE ACRYLATE SILICA TERPOLYMER

A silane acrylate silica terpolymer composition curable by ultraviolet light was used in this example, and is described in detail in U.S. Pat. No. 5,368,941, (Nov. 29, 1994), which is incorporated herein by reference. This composition contained (i) a multifunctional acrylate monomer which was a mixture of trimethylolpropane triacrylate and 1,6-hexanediol diacrylate, (ii) an amino functional silane which was 3-aminopropyl triethoxysilane, (iii) colloidal silica, and (iv) an acrylate terminated polyalkylene oxide which was diethylene glycol diacrylate. It is shown in the '941 patent as Composition No. 1in Table 1, and the composition was prepared according to the '941 patent's directions for the preparation of Solutions A and B, all of which are set forth in detail in the '941 patent.

The composition was catalyzed with 4% by weight DAROCURE® 1173 free radical photoinitiator which is hydroxymethylphenylpropanone, available from Ciba-Geigy Corporation, Greensboro, N.C. In a separate container, there was prepared a 12% by weight solution of polyvinyl alcohol having a number average molecular weight of 89,000 and a degree of saponification above 99 mole percent in an aqueous dimethylsulfoxide (DMSO) solution. The ratio of water to DMSO in the solution was 1:4 based on weight. The solution was heated to 110° C. with continuous stirring under an inert nitrogen atmosphere for one hour until the PVA was completely dissolved. The PVA solution and the UV curable ≡SiO— containing material were extruded simultaneously through the annular passage of a die assembly consisting of a circular inner passage having a diameter of 3.7 mm into which the ≡SiO— containing material was directed, and a concentric annular passage having an inner diameter of 5.9 mm and an outside diameter of 10 mm into which the PVA solution was directed. Adjustment to flow of the ≡SiO— containing material and the PVA solution were made by controlling the pressure above these two components. Under the temperature and viscosity conditions of these solutions, the PVA solution was extruded under 12 psi (83 kPa) and the ≡SiO— containing material was fed by gravity from a height of 6 ft (1.8 meters). The tip of the spinneret was set vertically about 2 cm above a coagulating bath composed of acetone cooled with dry ice. The extruded multicomponent filament traveled in the bath a total distance of 244 cm and was pulled by a winder rotating at 110 RPM (1.2 rad/s). This completely solidified the outer sheath of PVA around the core component of the ≡SiO— containing material. The speed of the take-up winder was controlled to affect the dimension of the extruded multicomponent filament. The wound multicomponent filament was immersed in acetone after the winding operation, and was drawn down at room temperature by transfer to another spool rotating at a higher speed than the feeding spool. The fiber obtained was transferred between two reels rotating at the same speed through a UV source. The UV source employed was a model HANOVIA 6506A431 a speed of 6 ft/min (0.03 meters per second) using 300 watts/square inch (465,000 watts per square meter). A complete cure of the ≡SiO— containing material was obtained. Portions of the filament composed of the cured ≡SiO— containing material core surrounded by the PVA protective sheath were immersed in a hot solution containing water and DMSO held at 90° C. which dissolved away the PVA to release a flexible fiber. Photomicrographs of the fiber showed a substantially uniform geometry about 250 μm in diameter with a circular cross-section.

EXAMPLE 4

Example 3 was repeated except that an 8% by weight PVA in aqueous DMSO solution was used to form the protective sheath. This lower viscosity solution yielded higher throughput of PVA at the same pressure, and resulted in a lower modulus protective sheath that was easier to draw down. It was observed however that the higher concentration of DMSO appeared to incorporate into the ≡SiO— containing material component, with the result that the optical transparency of the fiber upon curing was reduced.

Fibers made according to Examples 3 and 4 are useful in fabricating low transmission loss optical fibers, structural fillers for improved reinforcement of silicone compositions, fiberglass insulation replacements, or woven and non-woven fabrics.

The embodiment of our invention in Examples 3 and 4 is of particular significance and unexpected, when it is considered that thin films cast from such silane acrylate silica terpolymers are typically brittle, whereas the spun fibers in Examples 3 and 4 were found to be flexible.

A number of multifunctional acrylate monomers other than trimethylolpropane triacrylate and 1,6-hexanediol acrylate can be used to form the silane acrylate silica terpolymer such as 1,4-butanediol diacrylate; ethylene glycol diacrylate; diethylene glycol diacrylate; tetraethylene glycol diacrylate; tripropylene glycol diacrylate; neopentyl glycol diacrylate; 1,4-butanediol dimethacrylate; poly(butanediol)diacrylate; tetraethylene glycol dimethacrylate; 1,3-butylene glycol diacrylate; triethylene glycol diacrylate; triisopropylene glycol diacrylate; polyethylene glycol diacrylate; bisphenol A dimethacrylate; trimethylol propane trimethacrylate; pentaerythritol monohydroxy triacrylate; trimethylolpropane triethoxy triacrylate; pentaerythritol tetraacrylate; di-trimethylolpropane tetraacrylate; dipentaerythritol (monohydroxy) pentaacrylate; or mixtures thereof.

In addition to 3-aminopropyltriethoxysilane, silanes such as 3-aminopropyltrimethoxysilane and 3-aminopropyl methyl dimethoxysilane, are also appropriate. Further, acrylate terminated polyalkylene oxides other than diethylene glycol diacrylate can be used, such as tetraethylene glycol diacrylate and polyethylene glycol diacrylate.

It should be noted that many water soluble polymers can be extruded from a water solution. However, water soluble polymers such as polyglycols, polypyrrolidones, polyacrylates, polyacrylamides, polyimines, and various natural polymers, are not appropriate for use according to the process of our invention because (i) they do not have sufficient mechanical strength, (ii) they are too susceptible to subsequent swelling in water, and/or (iii) they will not solidify or gel in our process, as efficiently as PVA.

Therefore, PVA is most suitable in order to avoid such drawbacks. In addition, gelation of PVA is induced by non-covalent crosslinks (i.e. crystallization and hydrogen bonding), which enables its removal as a coating by simple dissolution in hot water or other suitable solvent. Furthermore, PVA is transparent to UV radiation used for curing in certain of the embodiments according to our invention.

Water soluble derivatives of cellulose such as cellulose acetate (CA), are appropriate substitutes for PVA. However, CA suffers from the disadvantage of being susceptible to microbial attack, and it is less resistant to temperature than PVA. Where those disadvantages are not a factor, CA can be an acceptable substitute for PVA. Other suitable PVA substitutes are water soluble derivatives of cellulose such as carboxymethylcellulose (CMC), hydroxyethyl cellulose, and hydroxypropyl cellulose.

Other variations and modifications may be made in the compounds, compositions, and methods described without departing from the essential features of the invention. The forms of the invention are only exemplary and not intended as limitations on its scope as defined in the claims.

That which is claimed is:

1. A process for producing filaments comprising coextruding an extrudable and curable ≡SiO— containing material and an aqueous organic polymer solution through a spinneret into a continuous filament, the filament having curable ≡SiO— containing material formed as an inner sheath surrounded by an outer sheath of organic polymer, passing the coextruded filament into a bath to coagulate the organic polymer as a solid elastomeric sheath around the inner sheath of curable ≡SiO— containing material, stretching the resulting filament and elongating the filament to a predetermined diameter, curing the inner sheath of ≡SiO— containing material, removing the outer sheath of organic polymer, and winding and collecting a cured filament of ≡SiO— containing material.

2. A process according to claim 1 in which the extrudable and curable ≡SiO— containing material is selected from the group consisting of (i) a curable silicone rubber, (ii) a curable water based silicone emulsion, and (iii) a curable silane acrylate silica terpolymer.

3. A process according to claim 1 in which the organic polymer is polyvinyl alcohol or a water soluble derivative of cellulose.

4. A process according to claim 3 in which the bath contains acetone or methanol.

5. A process according to claim 2 in which the inner sheath of ≡SiO— containing material is cured by the application of heat, the evaporation of water, or exposure to ultraviolet radiation.

6. A process according to claim 3 in which the outer sheath is removed by dissolving it in water, dimethylsulfoxide, or mixtures thereof.

7. A process for producing filaments comprising coextruding (A) an extrudable and curable ≡SiO— containing material selected from the group consisting of (i) a curable silicone rubber, (ii) a curable water based silicone emulsion, and (iii) a curable silane acrylate silica terpolymer, and (B) an aqueous organic polymer solution of polyvinyl alcohol or a water soluble derivative of cellulose, through a spinneret into a continuous filament, the filament having curable ≡SiO— containing material formed as an inner sheath surrounded by an outer sheath of the organic polymer, passing the coextruded filament into a bath to coagulate the outer sheath as a solid elastomeric sheath around the inner sheath of curable ≡SiO— containing material, stretching the resulting filament and elongating the filament to a predetermined diameter, curing the inner sheath of ≡SiO— containing material, removing the outer sheath, and winding and collecting a cured filament of ≡SiO— containing material.

8. A process according to claim 7 in which the bath contains acetone or methanol.

9. A process according to claim 7 in which the inner sheath of ≡SiO— containing material is cured by the application of heat, the evaporation of water, or exposure to ultraviolet radiation.

10. A process according to claim 7 in which the outer sheath is removed by dissolving it in water, dimethylsulfoxide, or mixtures thereof.

* * * * *